US005207936A

United States Patent [19]

Anzai et al.

[11] Patent Number: 5,207,936

[45] Date of Patent: May 4, 1993

[54] GREASE COMPOSITION FOR CONSTANT VELOCITY JOINT

[75] Inventors: Yasuyuki Anzai, Kamakura; Kiyoshi Takeuchi, Odawara; Yoshikazu Fukumura; Yukio Hasegawa, both of Iwata, all of Japan

[73] Assignee: NTN Corporation, Osaka, Japan

[21] Appl. No.: 834,763

[22] Filed: Feb. 13, 1992

[30] Foreign Application Priority Data

Apr. 1, 1991 [JP] Japan ..... 3-094748

[51] Int. Cl.[5] ..... C10M 141/02; C10M 141/06; C10M 141/08; C10M 141/10

[52] U.S. Cl. ..... 252/25; 252/33.6; 252/32.7 E; 252/32.7 R; 252/46.6

[58] Field of Search ..... 252/33.6, 32.7 E, 25, 252/26, 46.6, 32.7 R

[56] References Cited

U.S. PATENT DOCUMENTS

| | | | |
|---|---|---|---|
| 3,509,051 | 4/1970 | Farmer et al. | 252/33.6 |
| 3,840,463 | 10/1974 | Froeschmann et al. | 252/32.7 E |
| 3,844,955 | 10/1974 | Green | 252/21 |
| 4,098,705 | 7/1978 | Sakuri et al. | 252/33.6 |
| 4,406,800 | 9/1983 | Christian | 252/33.6 |
| 4,840,740 | 6/1989 | Sato et al. | 252/32.7 E |
| 4,857,220 | 8/1989 | Hashimoto | 252/32.7 E |
| 5,059,336 | 10/1991 | Naka et al. | 252/33.3 |

FOREIGN PATENT DOCUMENTS

| | | |
|---|---|---|
| 0386653 | 9/1990 | European Pat. Off. . |
| 0435745 | 7/1991 | European Pat. Off. . |
| 2592891 | 7/1987 | France . |
| 62-207397 | 9/1987 | Japan . |
| 2-020597 | 1/1990 | Japan . |

*Primary Examiner*—Prince Willis, Jr.
*Assistant Examiner*—Alan D. Diamond
*Attorney, Agent, or Firm*—Young & Thompson

[57] ABSTRACT

A grease composition for constant velocity joint is a particular combination of a urea grease composed of a lubricating oil and a urea base thickener with (A) molybdenum sulfide dialkyldithiocarbamate, (B) molybdenum disulfide, (C) zinc dithiophosphate and (D) an oiliness agent of at least one vegetable oils and fats and can attain not only reduction of induced thrust but also improvement of flaking resistance.

4 Claims, 3 Drawing Sheets

Evaluation

○: Good

△: Slightly Bad

×: Bad

GREASE COMPOSITION FOR CONSTANT VELOCITY JOINT

BACKGROUND OF THE INVENTION

1. Field of the Invention

This invention relates to a grease composition for use in constant velocity joints of vehicles, particularly double-offset type constant velocity joints. More particularly, it relates to a grease composition for constant velocity joint which can efficiently lubricate a portion to be lubricated, effectively reduce wearing, control vibrations and better improve the durable life, because the constant velocity joint is under severe conditions and is apt to be worn and generate abnormal vibrations and the like.

2. Disclosure of the Related Art

Heretofore, lithium base extreme pressure grease containing sulfur-phosphorus series extreme pressure additive, lithium base extreme pressure grease containing molybdenum disulfide and the like have been used in this type of constant velocity joint. Furthermore, Japanese Patent laid open No. 62-207397 discloses that sulfur-phosphorus base extreme pressure additive comprised of molybdenum sulfide dialkyldithiocarbamate and at least one of sulfurized oil, olefin sulfide, tricresyl phosphate, trialkylthio phosphate and zinc dialkyldithio phosphate is suitable as an essential component in the extreme pressure grease, but is not said to be sufficient and is found wanting from a viewpoint of noise reduction and durability.

Since the use of front-engine, front-wheel drive vehicles as well as functional 4-wheel drive vehicles is rapidly increasing from a viewpoint of weight reduction, safety of living space and the like, constant velocity joints (CVJ) are widely used in these vehicles. In FIG. 1 is shown a double offset type joint (DOJ) used as a slide type plunging joint among these constant velocity joints. When the joint transmits a rotating torque at a state of taking an operating angle in the double offset type joint, complicated rolling and sliding motions are created in the fitting of a ball 5 between a track groove 3 of an outer member 1 and a track groove 4 of an inner member 2 and hence force is generated in an axial direction of the joint through a friction resistance of a sliding portion. Such a force is called an induced thrust. Moreover, six track grooves 3 are arranged at an interval of 60° in the inner surface of the outer member 1 in the double offset type joint, so that six induced thrusts are generated per one rotation of the joint.

When the generation cycle of the induced thrust matches with natural frequencies of engine, vehicle body, suspension and the like, resonance is induced in the vehicle body to give an uncomfortability to crews, so that it is desired to reduce the induced thrust as far as possible. Further, when the vehicle is actually run at a high speed, there exists the inconvenience of generating beat noise, muddy noise or the like. Moreover, the lubricating conditions in the double offset type joint becomes more severe with the weight reduction and high output power of the vehicle, and hence it is required to prevent surface peeling (flaking) at friction surface due to metal fatigue or to improve the durability of the joint against damage or the like.

The known solutions to these problems, including the conventional lithium base extreme pressure grease containing sulfur-phosphorus series extreme pressure additive and lithium base extreme pressure grease containing molybdenum disulfide, still have a problem in resisting vibration and are not satisfactory from the standpoint of durability because the wearing is substantial under a high contact pressure and the flaking resistance is insufficient. On the other hand, the grease described in Japanese Patent laid open No. 62-207397 is insufficient to reduce generated vibrations and to resist flaking.

As a grease used under lubricating conditions is easily apt to cause the wearing and to generate vibrations, greases having a lower friction coefficient and an excellent flaking resistance are suitable since there is a known interrelation between friction coefficient and induced thrust in the resistance to vibrations.

As an evaluation of vibration resistance, the induced thrust in the actual joint was measured, and in addition, the friction coefficient, which interrelates the induced thrust of the actual joint was measured by means of a Savan's friction and wear testing machine. Furthermore, the flaking resistance was evaluated as a durability by a table test using the actual joint. As a result, the inventors have found that the combined effect of friction coefficient reduction and flaking life increase can be obtained by a combination of (A) molybdenum sulfide dialkyldithiocarbamate, (B) molybdenum disulfide, (C) zinc dithiophosphate and (D) an oiliness agent composed of one or more of vegetable oils and fats, and the invention has been accomplished.

SUMMARY OF THE INVENTION

According to the invention, there is provided a grease composition for constant velocity joint comprising a urea grease including a lubricating oil and a urea base thickener and containing (A) 1–5% by weight of molybdenum sulfide dialkyldithiocarbamate, (B) 0.2–1% by weight of molybdenum disulfide, (C) 0.5–3% by weight of an extreme pressure additive of zinc dithiophosphate represented by the following general formula:

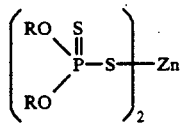

(wherein R is an alkyl group or an aryl group) and (D) 0.5–5% by weight of an oiliness agent composed of at least one of vegetable oils and fats as an essential component, provided that a weight ratio of the component (B) to the component (A) is 0.04–0.5.

BRIEF DESCRIPTION OF THE DRAWINGS

The invention will be described with reference to the accompanying drawings, wherein.

DESCRIPTION OF THE PREFERRED EMBODIMENTS

Figure 1:
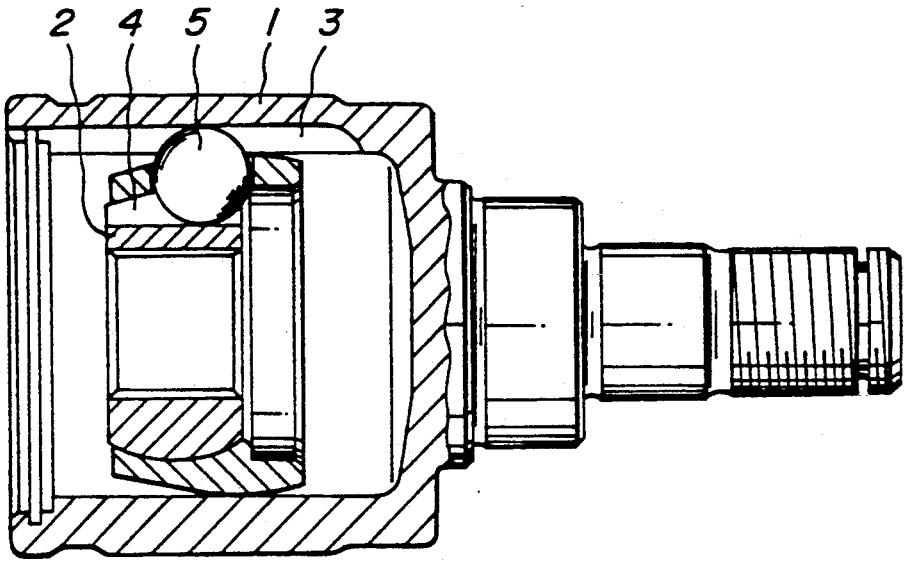
FIG. 1 is a side view partly shown in section of a double offset type joint using a grease composition according to the invention in places to be lubricated.

The urea grease used in the invention comprises a lubricating oil selected from at least one of mineral oil, synthetic ester oils, synthetic ether oils, synthetic hydrocarbon oils and the like as a base oil and a urea compound obtained by reacting aliphatic amine, alicyclic amine, aromatic amine or the like with an isocyanate compound as a thickener. Particularly, greases using the aliphatic amine are desirable in the invention.

The component (A) of molybdenum sulfide dialkyldithiocarbamate used in the invention is a compound represented by the following general formula:

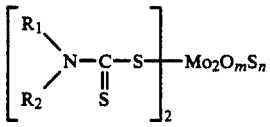

(wherein each of $R_1$ and $R_2$ is an alkyl group having a carbon number of 1–24, m is 0–3, n is 1–4 and m+n is 4), which is a well-known solid lubricant. For example, this compound is disclosed in Japanese Patent Application Publication No. 45-24562 (m=2.35–3, n=1.65–1), Japanese Patent Application Publication No. 5-1-964 (m=0, n=4) and Japanese Patent Application Publication No. 53-3164 (m=0.5–2.3, n=3.5–1.7), respectively. The component (A) used in the invention includes all of the compounds disclosed in the above references.

The component (B) of molybdenum disulfide used in the invention is usually and widely used as a solid lubricant. It has a layer lattice structure as a lubricating mechanism, which is easily sheared into thin layer form through sliding motion to obstruct metal contact and to provide an effect of preventing seizure.

However, when the amount of the component (B) is too large, the friction coefficient is increased to negatively affect the resistance to vibration and the friction may similarly be increased according to the lubricating conditions.

The component (C) used in the invention is an extreme pressure additive of zinc dithiophosphate having the above general formula. In such compounds, the group R can be classified into primary alkyl, secondary alkyl and aryl groups in accordance with the kind of alcohol used, but all groups are applicable in the invention. Particularly, the use of primary alkyl group has the largest effect.

As the component (D) used in the invention, mention may be made of vegetable oils and fats such as castor oil, soybean oil, rapeseed oil, coconut oil and the like. The oiliness agent composed of at least one of such vegetable oils and fats is easily adsorbed onto the metal surface to obstruct the contacting between metals.

Although these actions are not completely understood, they are considered as follows.

The urea compound as a thickener component in the urea grease is stable in the micellar structure as compared with a metallic soap grease and strong in its ability to stick to metal surface, so that it is believed that the buffering action obstructing the metal contact becomes stronger through the micellar film of the thickener. Furthermore, it is believed that the component (A) of molybdenum sulfide dialkyldithiocarbamate has the same effect as in dithiocarbamic acid vulcanization accelerator for rubber. Here, the effect of vulcanization accelerator means an effect that sulfur and rubbery hydrocarbon are activated to promote crosslinking reaction between hydrocarbon molecules through sulfur. By such an effect the sulfur and hydrocarbon residue of zinc dithiophosphate (component (C)) are activated to cause the crosslinking reaction between molecules, whereby a high molecular weight compound is produced, which covers the lubricating surface as a high polymer film having a viscoelasticity to absorb vibrations and prevent the metal contact to thereby avoiding the wear.

Moreover, it is contemplated that the oiliness agent of at least one vegetable oil and fat such as castor oil, soybean oil, rapeseed oil, coconut oil and the like as the component (D) intervenes into the lubricating surface to strongly adsorb onto metal and effectively acts to enhance the effects of the components (A) and (C).

When the amount of molybdenum disulfide added as the component (B) is too large, the effect of the components (A), (C), (D) for the prevention of vibrations may be obstructed which results in an increase in wearing and large vibrations. However, when the component (B) is used in a certain restricted amount, it is believed that adequate wearing prevents seizure under such a high contact pressure that the flaking is caused in the high polymer film formed by the effect of the components (A) and (C), whereby the effect of improving the flaking life is developed.

Moreover, it is considered that the effect of the component (B) is more effectively developed by the component (D).

When the amount of the component (A) is less than 1% by weight, the amount of the component (B) is less than 0.2% by weight, the amount of the component (C) is less than 0.5% by weight, and the amount of the component (D) is less than 0.5% by weight, there is simply no appreciable effect, while when the amount of the component (A) exceeds 5% by weight, the amount of the component (B) exceeds 1% by weight, the amount of the component (C) exceeds 3% by weight, and the amount of the component (D) exceeds 5% by weight, the increase of the effect is not expected and the prevention of vibrations becomes rather poor. Therefore, the amounts of the components (A), (B), (C) and (D) are 1–5% by weight, 0.2–1% by weight, 0.5–3% by weight and 0.5–5% by weight, respectively. Moreover, it is necessary that the weight ratio of the component (B) to the component (A) be within a range of 0.04–0.5.

The following examples are given in illustration of the invention and are not intended as limitations thereof.

Grease compositions of Examples 1–6 and Comparative Examples 1–5 were prepared according to a compounding recipe shown in Table 1 by the usual manner. The performances of the above grease compositions were evaluated together with commercially available organic molybdenum grease as Comparative Example 6 and commercially available molybdenum disulfide grease as Comparative Example 7 according to test methods as mentioned later.

1. Friction and wear test

Figure 2:
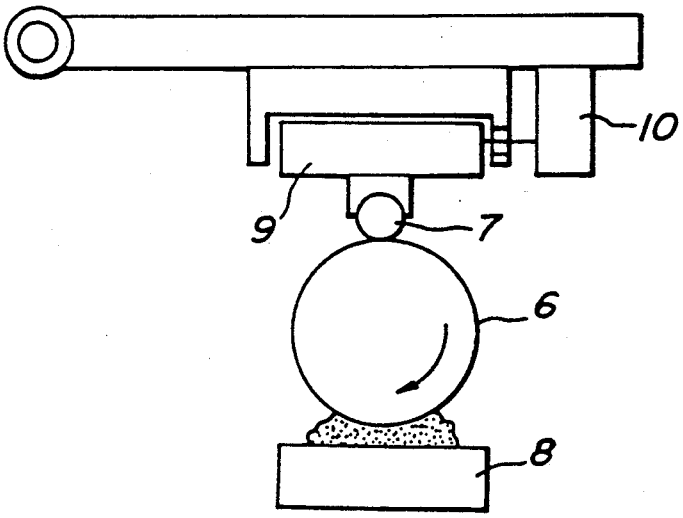
FIG. 2 is a schematic view illustrating a state of measuring friction coefficient by means of a Savan's friction and wear testing machine.

The friction coefficient was measured by means of a Savan's friction and wear testing machine to obtain results as shown in Table 1. The Savan's friction and wear testing machine was comprised by pressing a steel ball 7 of ¼ inch to a rotatable ring 6 of 40 mm in diameter and 4 mm in thickness as shown in FIG. 2. In the measurement of the friction coefficient, the rotatable ring 6 was rotated at a peripheral speed of 108 m/min under a load of 1.3 kgf, while a grease to be tested was supplied to the surface of the rotatable ring 6 through a sponge 8 located beneath the rotatable ring, during which a movement of an air slide 9 supporting the steel ball 7 was detected by means of a load cell 10.

Moreover, the testing time was 10 minutes, and the friction coefficient was measured after 10 minutes.

2. Test for the measurement of induced thrust

A force produced in an axial direction of an actual joint (double offset type joint) when the joint was rotated at given operating angle and torque was measured as an induced thrust.

Figure 3:
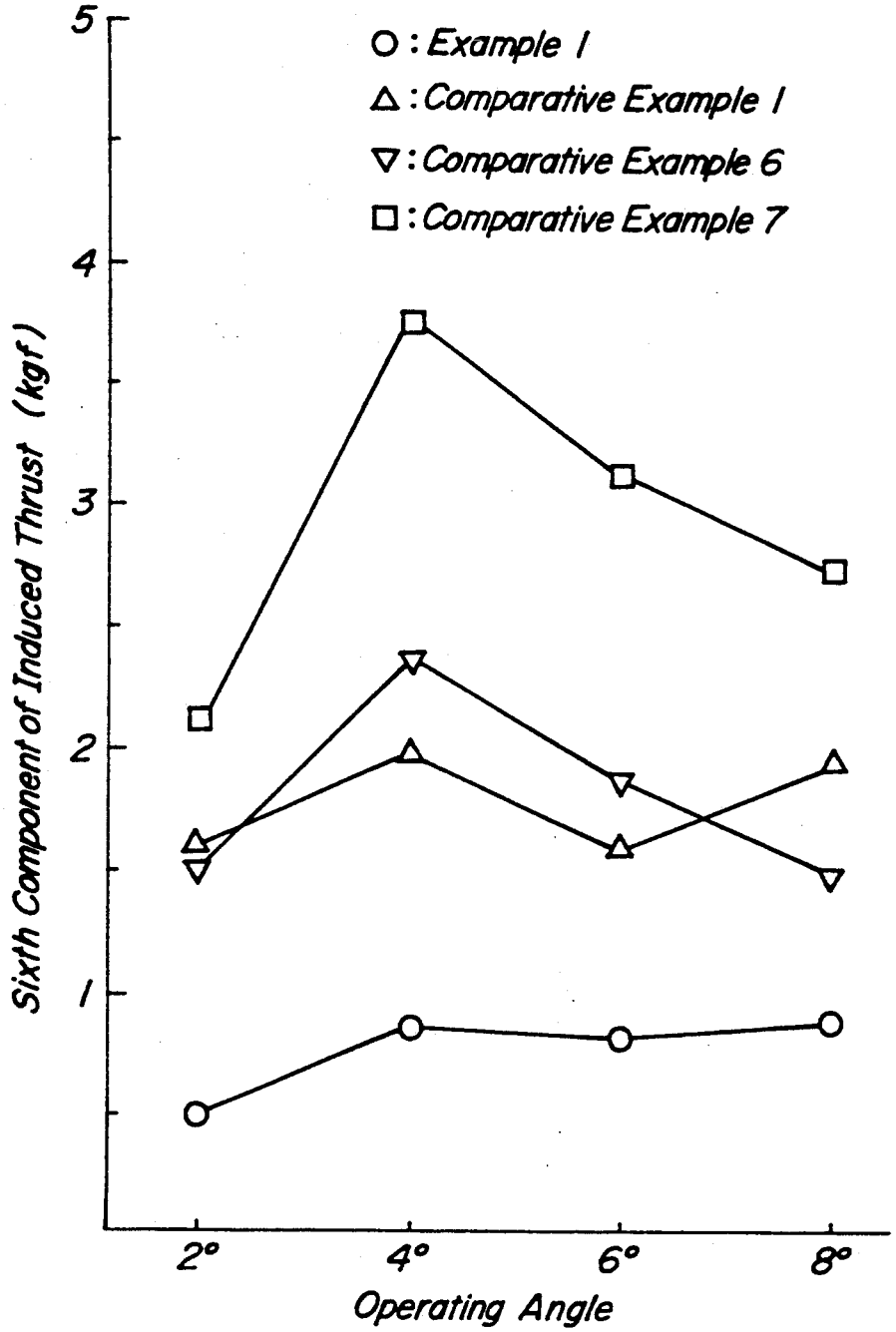
FIG. 3 is a graph showing measured results of induced thrust in Example 1 and Comparative Examples 1, 6 and 7.

The test results of the greases in Example 1 and Comparative Examples 1, 6 and 7 are shown in FIG. 3.

| Measuring conditions: | |
|---|---|
| Rotating number | 900 rpm |
| Torque | 15 kgf · m |
| Operating angle | 2, 4, 6, 8° |
| Testing time | 5 minutes |

3. Test for durable life

Figure 4:
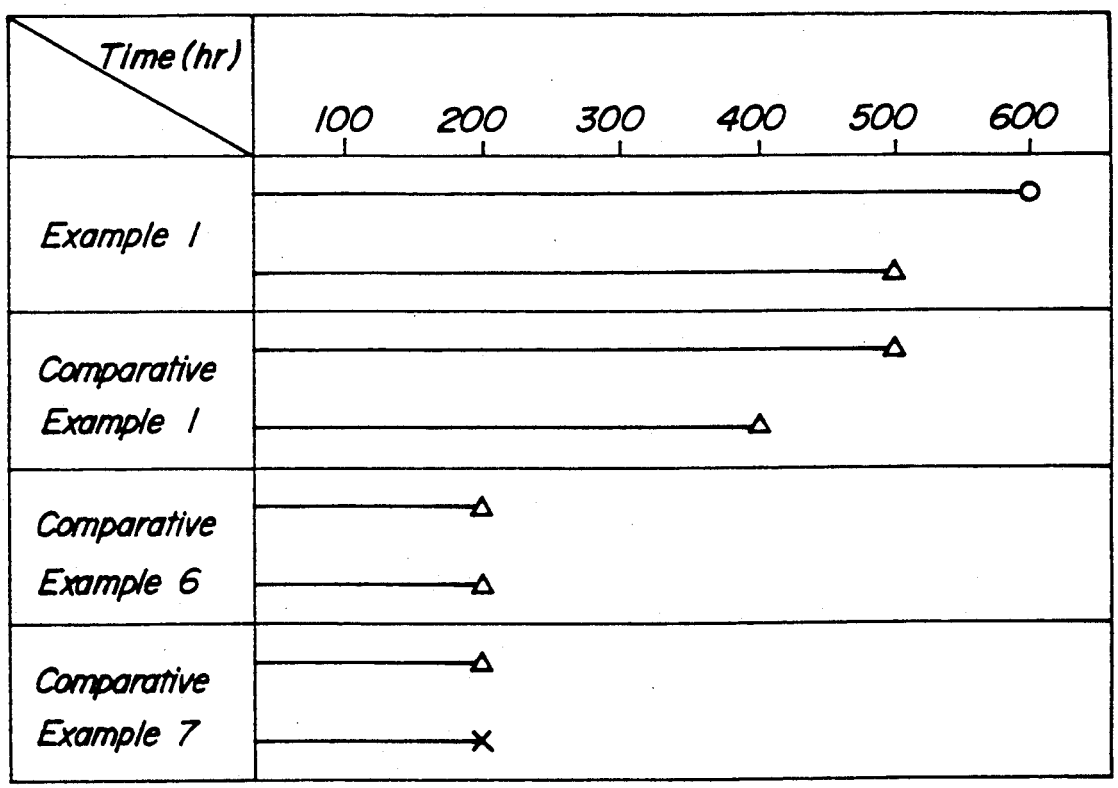
FIG. 4 is a graph showing measured results of durable life in Example 1 and Comparative Examples 1, 6 and 7.

The test for durable life was carried out by using a double offset type joint under the following conditions to evaluate the presence or absence of flanking. The test results of the greases in Example 1 and Comparative Examples 1, 6 and 7 are shown in FIG. 4.

| Measuring conditions: | |
|---|---|
| Rotating number | 1000 rpm |
| Torque | 53 kgf · m |
| Operating angle | 4.5° |

TABLE 1

| | | | Example | | | | | | Comparative Example | | | |
|---|---|---|---|---|---|---|---|---|---|---|---|---|
| | | | 1 | 2 | 3 | 4 | 5 | 6 | 1 | 2 | 3 | 4 |
| Composition (weight %) | Base grease | urea grease | 92.5 | 92.5 | 92.5 | 92.5 | 94.8 | 90.0 | 94.5 | 93.0 | 94.5 | 92.9 |
| | molybdenum sulfide dialkyldithiocarbamate | | 3.0 | 3.0 | 3.0 | 3.0 | 3.0 | 3.0 | 3.0 | 3.0 | 3.0 | 3.0 |
| | Additives | zinc dithiophosphate I (R: primary alkyl) | 2.0 | — | — | 2.0 | 2.0 | 2.0 | 2.0 | 2.0 | — | 2.0 |
| | | zinc dithiophosphate II (R: secondary alkyl) | — | 2.0 | — | — | — | — | — | — | — | — |
| | | zinc dithiophosphate III (R: aryl) | — | — | 2.0 | — | — | — | — | — | — | — |
| | | $MoS_2$ | 0.5 | 0.5 | 0.5 | 0.5 | 0.2 | 1.0 | 0.5 | — | 0.5 | 0.1 |
| | | Vegetable oil and fat | | | | | | | | | | |
| | | caster oil | 2.0 | 2.0 | 2.0 | — | 2.0 | 2.0 | — | 2.0 | 2.0 | 2.0 |
| | | Rapeseed oil | — | — | — | 2.0 | — | — | — | — | — | — |
| | Total | | 100 | 100 | 100 | 100 | 100 | 100 | 100 | 100 | 100 | 100 |
| Evaluation Items | Savan's friction and wear test Friction coefficient (μ) | | 0.042 | 0.045 | 0.043 | 0.046 | 0.042 | 0.049 | 0.075 | 0.040 | 0.090 | 0.044 |
| | Reduction ratio of induced thrust (%) | | −74 | −69 | −71 | −67 | −72 | −62 | −39 | — | — | — |
| | *Durability | | ◎ | ◎ | ◎ | ◎ | ◎ | ◎ | ○ | X | ○ | X |

| | | | Comparative Example | | |
|---|---|---|---|---|---|
| | | | 5 | 6 | 7 |
| Composition (weight %) | Base grease | urea grease | 91.0 | Commercially available organic molybdenum grease | Commercially available molybdenum disulfide grease |
| | molybdenum sulfide dialkyldithiocarbamate | | 3.0 | | |
| | Additives | zinc dithiophosphate I (R: primary alkyl) | 2.0 | | |
| | | zinc dithiophosphate II (R: secondary alkyl) | — | | |
| | | zinc dithiophosphate III (R: aryl) | — | | |
| | | $MoS_2$ | 2.0 | | |
| | | Vegetable oil and fat | | | |
| | | caster oil | 2.0 | | |
| | | Rapeseed oil | — | | |
| | Total | | 100 | | |
| Evaluation Items | Savan's friction and wear test Friction coefficient (μ) | | 0.092 | 0.080 | 0.119 |
| | Reduction ratio of induced thrust (%) | | — | −38 | ±0 |

TABLE 1-continued

| | | | |
|---|---|---|---|
| *Durability | ◎ | X | X |

◎: very excellent
○: excellent
X: poor
The following oil was used as a base oil
Kind of base oil mineral oil
viscosity 40° C. 100
(cSt) 100° C. 10.9
viscosity index 98

As seen from Table 1 and FIG. 3, the effect of reducing the friction coefficient and the induced thrust can be obtained according to the invention. Furthermore, it is apparent from FIG. 4 that the durable life is improved according to the invention. That is, the grease composition for constant velocity joint according to the invention is a particular combination of a urea grease composed of a lubricating oil and a urea base thickener with (A) molybdenum sulfide dialkyldithiocarbamate, (B) molybdenum disulfide, (C) zinc dithiophosphate and (D) at least one of vegetable oils and fats such a castor oil, soybean oil, rapeseed oil, coconut oil and the like, and can attain not only the reduction of induced thrust but also the improvement of the flaking resistance in the constant velocity joint such as double offset type joint or the like.

What is claimed is:

1. A grease composition for constant velocity joint comprising a urea grease composed of a lubricating oil and a urea base thickener and containing (A) 1-5% by weight of molybdenum sulfide dialkyldithiocarbamate, (B) 0.2-1% by weight of molybdenum disulfide, (C) 0.5-3% by weight of an extreme pressure additive of zinc dithiophosphate represented by the following general formula:

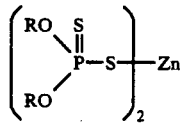

(wherein R is an alkyl group or an aryl group) and (D) 0.5-5% by weight of an oiliness agent composed of at least one of vegetable oils and fats as an essential component, provided that a weight ratio of the component (B) to the component (A) is 0.04-0.5.

2. A grease composition according to claim 1, wherein said component (A) is a solid lubricant represented by the following general formula:

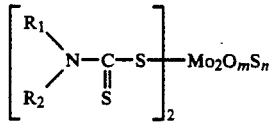

(wherein each of $R_1$ and $R_2$ is an alkyl group having a carbon number of 1-24, m is 0-3, n is 1-4 and m+n is 4).

3. A grease composition according to claim 1, wherein said alkyl group of the formula in said component (C) is a primary or secondary alkyl group.

4. A grease composition according to claim 1, wherein said vegetable oil and fat of said component (D) is at least one of castor oil, soybean oil, rapeseed oil and coconut oil.

* * * * *